United States Patent [19]

Karwoski

[11] Patent Number: 4,787,405

[45] Date of Patent: Nov. 29, 1988

[54] CONVERTIBLE CRUTCH

[76] Inventor: Daniel E. Karwoski, 4149 Georgian Dr., Ferndale, Wash. 98248

[21] Appl. No.: 887,526

[22] Filed: Jul. 21, 1986

[51] Int. Cl.[4] ..... A45B 3/00

[52] U.S. Cl. ..... 135/66; 135/65; 135/68; 135/75; 403/109

[58] Field of Search ..... 135/65, 66, 67, 68, 135/69, 73, 74, 78, 77, 70, 75; 16/42 R; 33/285

[56] References Cited

U.S. PATENT DOCUMENTS

| | | | |
|---|---|---|---|
| 835,108 | 11/1906 | Hovis | 135/70 |
| 2,373,045 | 4/1945 | Osborn | 135/69 |
| 2,388,778 | 11/1945 | Wheeler | 135/68 |
| 2,568,654 | 9/1951 | Neptune | 135/68 |
| 3,157,187 | 11/1964 | Murcott | 135/73 |
| 3,177,884 | 4/1965 | Turo | 135/77 |
| 3,768,495 | 10/1973 | Smith | 135/69 |
| 3,947,140 | 3/1976 | Thomas | 135/69 |

*Primary Examiner*—Robert A. Hafer
*Assistant Examiner*—Charles H. Sam
*Attorney, Agent, or Firm*—Anderson, Jr. Stanley E.; George C. Myers, Jr.; Arthur P. Gershman

[57] ABSTRACT

A convertible crutch is disclosed having a generally L-shaped upper support section to a generally S-shaped central support section connected, in turn, to a substantially straight lower support portion. The connection mechanism between the upper support section and the central support section can be utilized to connect the upper support section to the lower support section and convert the crutch to a cane when the central support section is removed.

7 Claims, 3 Drawing Sheets

CONVERTIBLE CRUTCH

BACKGROUND OF THE INVENTION

1. Field of the Invention

The present invention relates to a convertible crutch device and more particularly to a lightweight tubular crutch which may be converted from a crutch into a cane.

2. Description of the Prior Art

A search of the prior art failed to uncover any prior art references which disclose the convertible crutch of the present invention. A number of patents were uncovered which disclose convertible crutches. U.S. Pat. No. 2,960,095 to Smith, Jr. for example, discloses a convertible cane-crutch in which the crutch crossbar, which supports the user under the arm, is pivoted and folded into a vertical position aligned with the upper crutch member extending between the arm and hand support of the crutch. The crossbar is then telescoped with the upper crutch member into the lower crutch member extending between the ground and the hand support to convert the crutch into a cane. Thus, the hand support of the crutch is also used as the hand support for the cane. Furthermore, the entire weight of the crutch is carried with the cane even though portions of the crutch are unnecessary when the crutch is used as a cane.

U.S. Pat. No. 2,408,604 to Brickson discloses a convertible crutch which also uses the hand support of the crutch as the hand support for the cane when the crutch is converted to a cane by rotating or detaching the crutch arm support and upper crutch section. U.S. Pat. No. 869,128 to Autenrieth discloses a convertible crutch in which the upper crutch member is detachable for converting the crutch to a cane. Thus, in Autenrieth, as in Smith, Jr. and Brickson, the hand support of the crutch is also used as the hand support for the cane.

Also uncovered in the search was U.S. Pat. No. 2,388,778 to Wheeler, which discloses a crutch wherein the upper crutch member is rotatable about the axis of the hand support so as to lie adjacent the lower crutch member and is secured in place by a spring-loaded pin in the hand grip. It has been found that a pin in the hand grip of a crutch as in Wheeler has a tendency to wear out the pin hole under the constant application of lateral pressure thus causing the joint to become loose and flimsy. U.S. Pat. Nos. 3,133,551 and 3,157,187 to Murcott and U.S. Pat. No. 3,710,807 to Ferry disclose tubular, telescoping crutches which are not convertible into a cane. U.S. Pat. Nos. 281,245 and 2,116,941 to Degenhart and Francis, respectively, disclose spike tips for use on crutches or canes for contacting the ground in a non-slip manner.

Several of the aforementioned prior art patents disclose crutches having means for adjusting the spacing between the crutch arm support and hand support and between the hand support and the ground-engaging tip of the crutch by means of telescoping members with spring-biased locking pins (Ferry, Murcott, Smith, Jr.) or by means of screws, fixed pins or the like (Wheeler, Brickson, Autenrieth). While spring-biased pins are much more convenient and readily adjustable than screws, there is always the danger that the pins will become worn or disengaged resulting in inadvertent telescoping of the crutch and possible injury to the user. Where screws are used, of course, tools are required to adjust the position of the arm and hand supports of the crutch.

SUMMARY AND OBJECTS OF THE INVENTION

In view of the foregoing limitations and shortcomings of the prior art crutch devices, as well as other disadvantages not specifically mentioned above, it should be apparent that there still exists a need in the art for a lightweight crutch device which is readily and conveniently convertible to a cane and which has a rigid, safe and secure supporting mechanism throughout the length of the device, whether the device is used as a crutch or as a cane.

It is, therefore, a primary objective of the invention to fulfill that need by providing a lightweight tubular convertible crutch which is easily and quickly convertible into a cane without sacrificing strength or safety.

More particularly, it is an object of this invention to provide a convertible crutch which can be economically manufactured at a cost which is comparable to that of producing a conventional non-convertible crutch.

It is another objective of this invention to provide a convertible crutch which has telescoping joints in the upper and lower crutch members for adjusting the height of the arm and hand supports and a dual locking mechanism for each joint to prevent injury to the user because of inadvertent telescoping of either joint.

Another object of this invention is to provide a crutch which is light in weight when it is converted for use as a cane.

Still another object of this invention is to provide a convertible crutch which is sleek and aesthetically pleasing in appearance when used as either a crutch or a cane, so as to subject the user to the minimum embarrassment attendant the use of a crutch or cane.

Yet another important object of the invention is to provide a crutch which is designed to generate a controllable forward thrust in response to the application of body weight to the hand and arm supports of the crutch.

Briefly described, the aforementioned objects are accomplished according to the invention by providing four thin-walled aluminum tubular sections which are connected together with two telescopic joints for use as an adjustable length crutch. A generally L-shaped upper crutch section has a horizontal portion which serves as either a crutch arm support or a cane hand support and a vertical portion which terminates in a connection means. A generally S-shaped central section has a horizontal hand support portion for the crutch located between a first or upper portion which extends vertically upwardly from one end of the horizontal portion and a second or lower portion which is inclined generally downwardly from the other end of the horizontal portion. The vertical portion of the L-shaped upper section is telescopically received in the upper vertical portion of the S-shaped central section which includes a connection means adapted to mate with the connection means of the upper L-shaped section of the crutch. A connection means is also provided on the free end of the second or lower portion of the S-shaped central section.

A lower straight support section of the crutch has a lower portion with a ground engaging tip telescopically received in an upper portion which terminates in a connection means adapted to mate either with the connection means of the second or lower portion of the central S-shaped support section or with the connection means of the upper L-shaped support section. The central S-shaped support section is adapted to be readily disengaged from its crutch-forming connections with the upper L-shaped support section and the lower support section, and the upper L-shaped support section is adapted to be connected directly to the lower support section to convert the crutch into a strong, lightweight cane. The horizontal portion of the upper L-shaped support section is thus used both for the underarm support for the user when the device is used as a crutch and as the hand support for the user when the device is used as a cane.

The telescopic joints in the lower support section and between the L-shaped upper support section and the S-shaped central support section are provided with adjustable connection means for securely locking the telescoping members together with the hand and arm supports at predetermined distances from the ground-engaging tip of the crutch. The telescoping joints are locked together by connection means comprising spring-biased detent buttons or pins engageable with mating apertures in the tubular members and compression rings or locking collars which frictionally lock the telescopic joints together.

The arm and hand supports are arranged with respect to the axis of the lower support section and ground-engaging tip so as to create clockwise and counterclockwise moments in response to the application of body weight to the arm and hand supports to thereby provide a controllable forward thrust to assist the user in walking with the crutch of the invention.

With the foregoing and other objects, advantages and features of the invention that will become hereinafter apparent, the nature of the invention may be more clearly understood by reference to the following detailed description of the invention, the appended claims, and to the several views illustrated in the attached drawings.

DETAILED DESCRIPTION OF A PREFERRED EMBODIMENT

Figure 1:
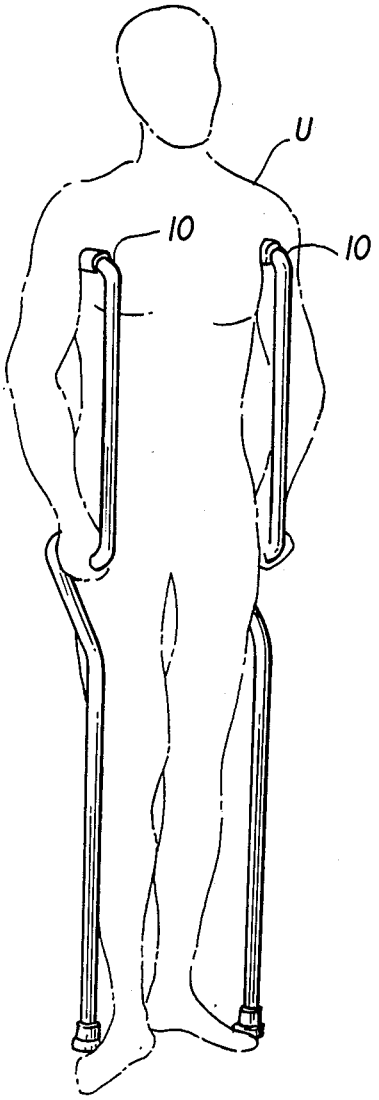
FIG. 1 is a perspective view illustrating the use of a pair of convertible crutches according to the invention.
Figure 2:
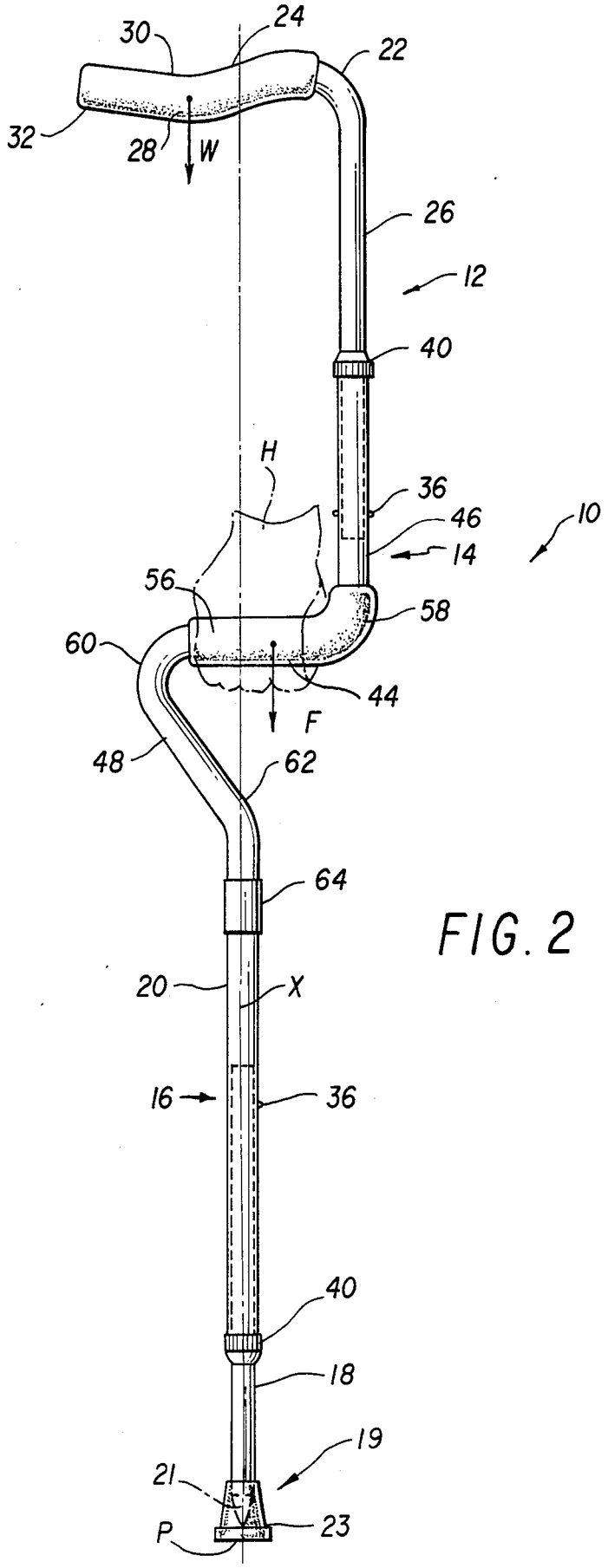
FIG. 2 is a side elevation view of a device in accordance with present invention assembled for use as a crutch.
Figures 4, 5:
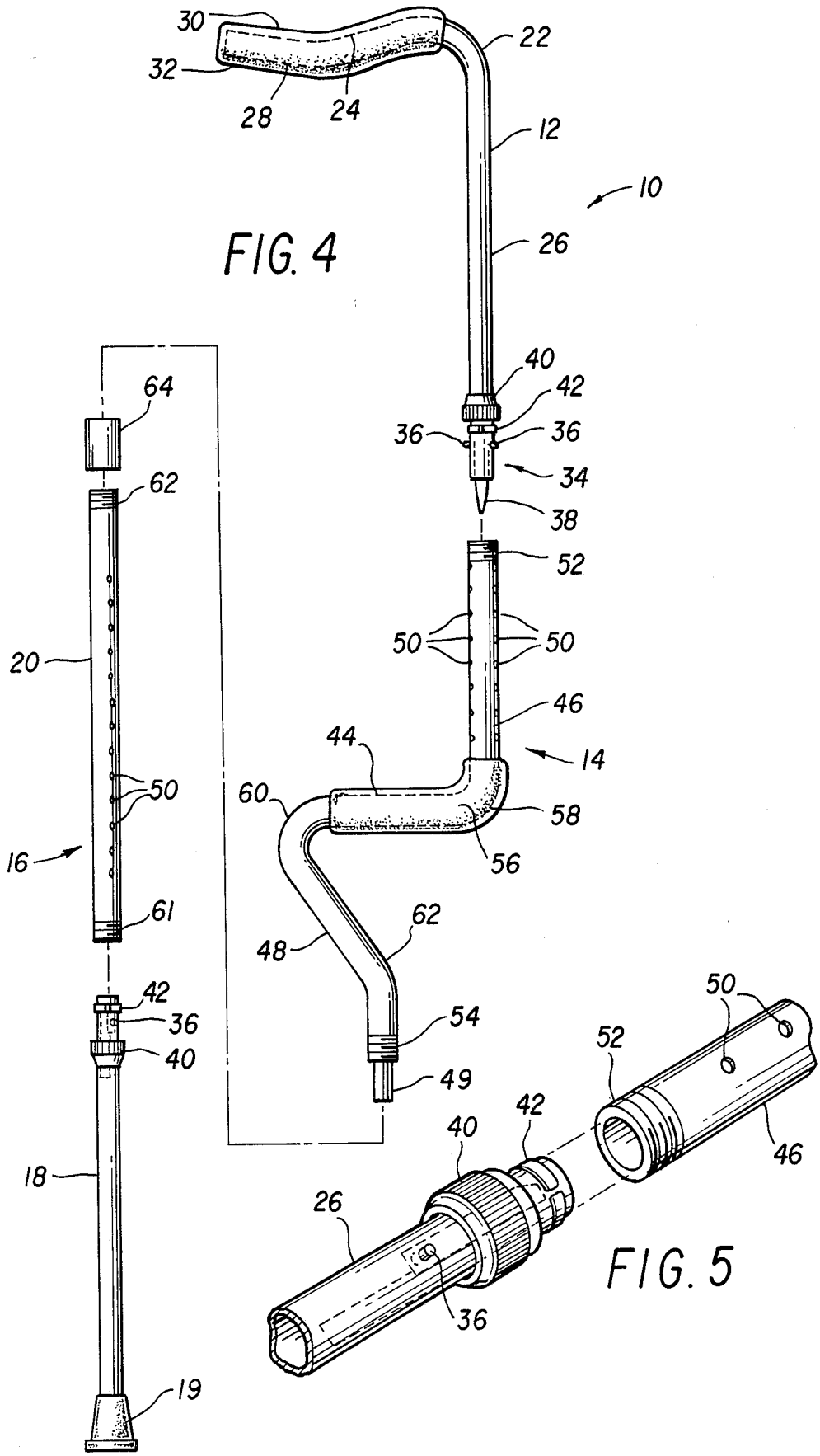
FIG. 4 is an exploded side elevation view showing the four main tubular sections of the convertible crutch according to the invention.
FIG. 5 shows a fragmentary detail of a typical connection at a telescopic joint of the convertible crutch according to the invention.

Referring now in detail to the drawings wherein like parts are designated by like reference numerals throughout, there is illustrated in FIG. 1 a user U using a pair of convertible crutches 10 constructed in accordance with the invention. Referring now to FIGS. 2 and 4, the convertible crutch 10 comprises a generally L-shaped upper support section 12, a generally S-shaped central section 14, and a vertically extending lower support section 16. In the preferred embodiment, lower support section 16 comprises a lower portion 18 with a tip 19 and an upper portion 20 which are telescopically connected for adjusting the length of lower support section 16 as described in greater detail hereinafter. Tip 19 comprises a steel spike 21 threadably secured in the free end of lower portion 18 and covered by a removable rubber walking tip 23. Steel spike 21 is used to provide non-slip footing for the tip in ice and snow.

Upper support section 12 is formed from a single piece of aluminum tubing with a bend 22 to form a generally horizontal arm support portion 24 and a vertical portion 26. Horizontal portion 24 is bent so that it forms an angle of somewhat less than 90° with respect to vertical portion 26 and has an additional, oppositely directed bend 28 at its approximate midpoint to form a concavely curved portion 30 so that the underarm of the user U comfortably rests in curved portion 30 when the convertible crutch 10 is used in the crutch configuration illustrated in FIGS. 1, 2, and 4. A replaceable sponge rubber sleeve 32 covers the horizontal portion 24 of upper section 12 to further enhance the comfort of the user U.

Vertical portion 26 of upper support section 12 extends vertically downwardly from bend 22 and terminates in a connection means 34. In the preferred embodiment, the connection means 34 (FIG. 4) comprises a pair of oppositely disposed, spring-loaded detent buttons 36 which project from the end of an outwardly-bias folding leaf spring 38. Detent buttons 36 project through apertures which are appropriately formed adjacent the free end of vertical portion 26. A knurled compression ring or locking collar 40 is internally threaded and cooperates with a plastic split ring 42 in a manner to be hereinafter described. As shown in FIG. 4, detent buttons 36 retain locking collar 40 and split ring 42 on the end of vertical portion 26 in the unassembled condition.

Generally S-shaped central support section 14 includes a horizontal portion 44 which is located between an upwardly extending upper vertical portion 46 and a downwardly extending lower inclined portion 48. Central support section 14 comprises a single piece of tubing, thereby forming a rigid, one-piece, unarticulated tubular member. Upper vertical portion 46 telescopically receives the free end of vertical portion 26 and is provided with a plurality of apertures 50 disposed on diametrically opposite sides thereof for engaging the spring-loaded buttons 36 of the upper section 12. Upper vertical portion 46 and lower inclined portion 48 are each provided at their free ends with an external thread 52, 54, respectively. Bend 58 formed in central section 14 defines a 90° angle at the transition between upper vertical portion 46 and horizontal portion 44. Bend 60, which forms the transition between lower inclined portion 48 and horizontal portion 44, is made so that portion 48 forms an acute angle of less than 90° with respect to horizontal portion 44. An additional oppositely directed bend 62 reorients portion 48 vertically into parallel relation with respect to upper vertical portion 46. A short tubular extension 49 extends beyond threaded end 54 for a purpose to be hereinafter described. A replaceable sponge rubber sleeve 56 is slipped over one end of central section 14 and covers horizontal portion 44 and bend 58 to provide comfort for the hand of the user.

As can best be seen in FIG. 2, the hand H of the user grips horizontal portion 44 at a point just forwardly of the axis X of lower support section 16 and the point P at which the crutch engages the ground at tip 19. This arrangement advantageously enables the user to obtain a forward thrusting motion to propel himself forward with a minimum of effort. Thus, when the user's body weight is applied vertically to the horizontal portion 44, a clockwise moment (as viewed in FIG. 2) is created between the downward force F of the body weight supported on the user's hand H and the vertical axis X or point P of the lower section 16.

As can also be seen in FIG. 2, the midpoint of curved portion 30 is arranged slightly rearwardly of the axis X of lower support section 16 and point P at tip 19. This feature enables the user to control the magnitude of forward thrust resulting from the above-described clockwise moment. By controlling the distribution of body weight between the hand at horizontal portion 44 and underarm at horizontal arm support portion 24, the user can reduce the magnitude of the forward thrust created by the clockwise moment by an opposing counterclockwise moment (as viewed in FIG. 2) created between the downward force W of the body weight supported on the user's underarm and the axis X of lower support section 16.

Lower support section 16 is comprised, in the preferred embodiment, of a lower portion 18 with a ground contacting tip 19 and an upper extension portion 20 into which lower portion 18 is telescopically received. Lower portion 18 is provided with a spring-loaded detent button 36 engageable in one of a longitudinal series of appropriately sized apertures 50 extending the entire length of extension portion 20. Both upper and lower free ends of extension portion 20 are externally threaded as at 61, 62. Lower portion 18 and upper extension portion 20 are each formed from a single piece of aluminum tubing, the internal diameter of extension portion 20 being sufficiently large as to telescopically receive lower portion 18, whereby the length of lower support section 16 may be adjusted to the appropriate size by means of detent button 36 engaging in an appropriate aperture 50. A knurled compression ring or locking collar 40 having a plastic split ring 42 is slid over detent button 36 for engagement with the threaded end 61 of extension portion 20 in order to provide a safe and secure engagement between the two portions 18, 20 once the appropriate length adjustment has been made.

The locking collars 40 and split rings 42 provide a back-up friction lock for the telescopic joint between the upper support section 12 and central support section 14 (FIG. 5), as well as for the telescopic joint between the tubular members 18, 20 of the lower section 16 (FIG. 4). An internally threaded coupling sleeve 64 is provided for coupling threaded end 54 of central section 14 with threaded end 62 of lower support section 16. Tubular extension 49 passes freely through sleeve 64 and then snugly into the upper free end of extension portion 20 to provide additional lateral support for the threaded connection at sleeve 64.

When the upper section 12, central section 14 and lower section 16 are assembled together as shown by the exploded assembly drawing of FIG. 4, the crutch 10 shown in FIG. 2 is formed. It is to be noted that the crutch 10 advantageously has means for adjusting the two critical measurements of the user, namely, the distance between the user's underarm and his hand which determines the distance between horizontal portions 24 and 44, and the distance between the underarm of the user and the bottom of his feet which determines the distance between horizontal portion 24 and the ground engaging tip 19. The crutch device 10 is also advantageously provided with a hand support, i.e., central section 14, which is a rigid, one-piece tubular construction and which is extremely stable and safe to use. The crutch design also has a sleek, pleasing appearance and is easily and inexpensively manufactured without sacrificing any requirements of strength or rigidity.

Figure 3:
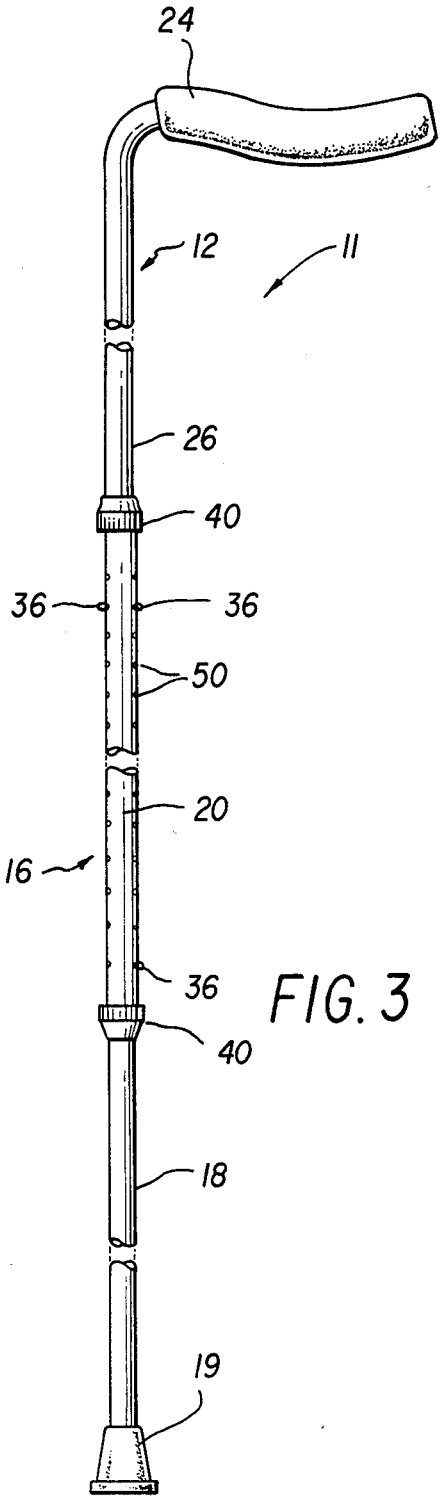
FIG. 3 is a side elevation view of a device in accordance with the invention assembled for use as a cane.

With reference now to FIG. 3, the various sections of the adjustable crutch of FIG. 2 have been disconnected and selected sections have been reassembled to form a cane, generally designated by reference numeral 11. Cane 11 is formed by connecting upper L-shaped support section 12 directly to lower support section 16. S-shaped central support section 14 is thus removed and set aside or stored when the crutch 10 is converted to cane 11. Apertures 50, which extend the full length of extension portion 20 of lower support section 16, serve as adjustment and connection means for the spring-loaded detent buttons 36 associated with both upper section 12 and lower section 16. Knurled compression rings 40 urge plastic split rings 36 into tight, frictionally gripping relation with vertical portions 18, 26 and thus provide a dual locking feature for each telescopic joint and safe and secure connections for the cane 11. It will also be noted that, in addition to central support section 14, threaded sleeve 64 has also been removed to assemble cane 11. If desired, the threaded connection between sleeve 64 and thread 54 on central section 14 may be made permanent by means, for example, of welding, brazing, cement, thread locking compounds or devices or any other suitable means.

Cane 11 assembled as shown in FIG. 3 is substantially lighter in weight than crutch 10. Furthermore, cane 11 has an extremely rigid design since the tubular members are telescoped and secured by means of spring-biased detents as well as friction locking collars. Additionally, cane 11 utilizes horizontal portion 24 as the hand support for the user, which is also used as the underarm support for the user in the crutch configuration. It will be noted that the design of the cane, similar to that of the crutch, has a sleek, appealing appearance. The cane 11 is also readily convertible to the crutch configuration and is extremely lightweight without sacrificing strength, rigidity or safety of the design.

It will be noted that in the specific embodiment presented, the position of detent buttons 36 has been illustrated on upper section 12, with mating apertures 50 being illustrated on central section 14 and lower section 16. It will be apparent to one skilled in the art, however, that those arrangements may be reversed and that various other quick disconnect connection means may be substituted for those illustrated herein.

Although only preferred embodiments are specifically illustrated and described herein, it will be appreciated that many other modifications and variations of the present invention are possible in light of the above teachings and within the purview of the appended claims without departing from the spirit and the intended scope of the invention.

What I claim is:

1. A crutch comprising an upper support section, a central support section, and a lower support section having a longitudinal axis, first means cooperating between the upper and central support sections for connecting the upper support section to the central support section and second means cooperating between the central and lower support sections for connecting the central support section to the lower support section, said central support section having a hand gripping portion intermediate the first and second connecting means, said hand gripping portion having a midpoint offset with respect to the longitudinal axis of the lower support section in a forwardly direction whereby a forward thrusting moment is created by a force applied downwardly at the midpoint of the hand gripping portion, said upper support section comprising an arm support portion spaced above said hand gripping portion, said arm support portion having a midpoint offset with respect to the longitudinal axis of the lower support section in a rearwardly direction whereby a rearward thrusting moment is created by a force applied downwardly at the midpoint of the arm support section, said upper support section being generally L-shaped, said first connecting means comprising a telescopic joint between said upper and central support sections and detent means engageable in a selected one of a plurality of apertures in one of said upper and central support sections for adjusting the distance between the arm support portion and the hand gripping portion, said first connecting means further comprising a locking collar means for frictionally locking the telescopic joint between said upper support section and said central support section, said second connecting means comprising a sleeve threadably connecting the central support section with the lower support section, whereby said upper support section is connectable to said lower support section whereby said crutch is adapted to be converted into a cane by removal of said central support section.

2. The crutch of claim 1, including removable sponge rubber sleeves covering said arm support and hand gripping portions.

3. The crutch of claim 1, wherein said central support section is a generally S-shaped, one-piece, unarticulated tubular member comprising said hand gripping portion, an upper vertical portion bent upwardly a substantially a right angle from one end of the hand gripping portion and a lower inclined portion bent downwardly at an acute angle with respect to the hand gripping portion.

4. The crutch of claim 1, wherein said lower support section comprises upper and lower tubular members and third means cooperating between the tubular members for connecting the tubular members together, said third connecting means comprising a telescopic joint between said upper and lower tubular members and detent means engageable in a selected one of a plurality of apertures in one of said tubular members for adjusting the length of the lower support section whereby the distance between the ground and said hand gripping portion is adjusted.

5. The crutch of claim 4, wherein said third connecting means further comprises a locking collar means for frictionally locking the telescopic joint between the upper and lower tubular members of the lower support section.

6. The crutch of claim 1, including a spike connected to the free end of the lower support section and a removable rubber tip covering said spike.

7. The crutch of claim 1, wherein said arm support portion has a bend intermediately thereof so as to be concavely curved.

* * * * *